United States Patent [19]

Roop et al.

[11] Patent Number: 5,044,181

[45] Date of Patent: Sep. 3, 1991

[54] DROPBOLT LOCK ASSEMBLY

[75] Inventors: Stevie C. Roop, Dugspur; Peter H. Field, Salem, both of Va.

[73] Assignee: Medeco Security Locks, Inc., Salem, Va.

[21] Appl. No.: 497,174

[22] Filed: Mar. 22, 1990

[51] Int. Cl.[5] ..... E05B 63/12

[52] U.S. Cl. ..... 70/131; 70/142

[58] Field of Search ..... 70/131, 134, 136, 142

[56] References Cited

U.S. PATENT DOCUMENTS

| | | | |
|---|---|---|---|
| 1,065,848 | 6/1913 | Segal . | |
| 1,922,043 | 8/1933 | Hines . | |
| 3,545,799 | 12/1970 | Gertsfeld . | |
| 3,768,284 | 10/1973 | Kent et al. . | |
| 4,530,223 | 7/1985 | Oliver . | |
| 4,617,811 | 10/1986 | Roop | 70/131 |
| 4,635,455 | 1/1987 | Oliver . | |
| 4,688,409 | 8/1987 | Oliver et al. . | |
| 4,719,774 | 1/1988 | Newman | 70/131 |
| 4,813,250 | 3/1989 | Yeh | 70/104 |
| 4,918,953 | 4/1990 | Newman | 70/131 |
| 4,961,330 | 10/1990 | Evans | 292/21 |

OTHER PUBLICATIONS

Segalock—Hines Key-System Brochure form The New England Lock & Hardware Co.

Medeco High Security Locks Brochure for the D-10 Series High Security Dropbolt.

*Primary Examiner*—Robert L. Wolfe

*Attorney, Agent, or Firm*—Rothwell, Figg, Ernst & Kurz

[57] ABSTRACT

A dropbolt lock having a pair of dropbolts movable between knuckles is assembled on a formed steel assembly plate which is attached to a base plate, the assembly plate providing the spaced knuckles. A cam operator operates the dropbolts between true dead lock positions. On the inside of the lock, a cylinder lock or a thumb turn may be assembled by a single screw. The cover is provided with attachment screws which are concealed by the locking bolt when in locked position.

15 Claims, 3 Drawing Sheets

DROPBOLT LOCK ASSEMBLY

BACKGROUND OF THE INVENTION

1. Field of the Invention

This invention relates to improvements in dropbolt lock assemblies.

2. Background and Prior Art

Dropbolt locks are locks in which a bolt is actuated to travel through holes in inter-engaging knuckles of the lock and a strike. Dropbolt locks are sometimes known as vertical deadbolts. Dropbolts are highly resistant to defeat and have been advertised as "jimmy-proof."

Dropbolt locks have been known for a number of years and there are a number of dropbolt locks on the market. Examples of dropbolt locks are shown in the following U.S. Pat. Nos.: 1,065,848 (1913); 1,922,043 (1933); 3,545,799 (1970); 3,768,284 (1973); 4,688,409 (1987); and 4,813,250 (1989). The foregoing patents are exemplary, not exhaustive, of the art on dropbolt locks.

Dropbolt locks typically have a bolt operated by a cam which travels vertically within holes of closely interfilling knuckles, one or more knuckles on a strike and the others on the lock. The cam and bolt may be operated from both sides of the door, typically via a cylinder lock on the outside and a handle (or other lock cylinder) on the inside.

Even though dropbolt locks are highly resistant to defeat, there is a need in the art to make them even more resistant to defeat, for example, in strengthening the attachment of the lock assembly to the door, preventing the mechanism from being removed from inside when the bolt is locked, providing a stronger assembly and making the bolt more resistant to cutting.

Additionally, in order to provide for convenience for locksmiths and for ease in assembly, the prior art locks are also susceptible to further improvement in assembly mechanisms and mounting arrangements.

Further, there is a need in the dropbolt lock field for locks which are easily adapted and convertible for use with indicating thumb turns or lock cylinders and/or protection for through-the-door mounting.

SUMMARY OF THIS INVENTION

In this invention, a dropbolt lock assembly of the type wherein a movable dropbolt is slidable within spaced knuckles and is operated by a cam assembly to move from locked to unlocked position, there are multiple improvements including a unique construction in which the lock assembly is assembled on a base plate attached to a mounting plate which is directly attached to the door through multiple mounting holes to provide a true surface flush mounting and resist prying off. Additional mounting plates can be utilized as shims for positioning the dropbolt while still being "jimmy proof." The bolt in its locked position covers and prevents access to mounting screws for the cover so that the cover of the dropbolt on the inside of the door cannot be removed unless the door is unlocked. A cam which operates the dropbolt is in a completely removable cage-like assembly which is attachable directly to the base plate and can accommodate either a thumb turn or an inside cylinder lock by a single screw attachment. Furthermore, the cam operates on a cam follower to create true deadlocking positions based on 90° cam action thus eliminating reliance on tension springs to completely deadlock the assembly. Further, the locking bolt is made of copper infused steel, not the usual steel casting or brass casting and is stronger in resistance to cutting. The assembly plate on which the lock is assembled is made of stamped and rolled steel which is more uniform and stronger than the usual brass casting, is easier to make and assemble and includes the spaced knuckles which wrap around the bolt. The lock is adaptable for a thumb turn which becomes an indicator and is easy to grasp for the handicapped and elderly. Additionally, the assembly is adaptable for complete through-the-door mounting with a guard plate on the outside to create an extremely secure locking assembly.

DETAILED DESCRIPTION OF THE PREFERRED EMBODIMENT

Figure 1:
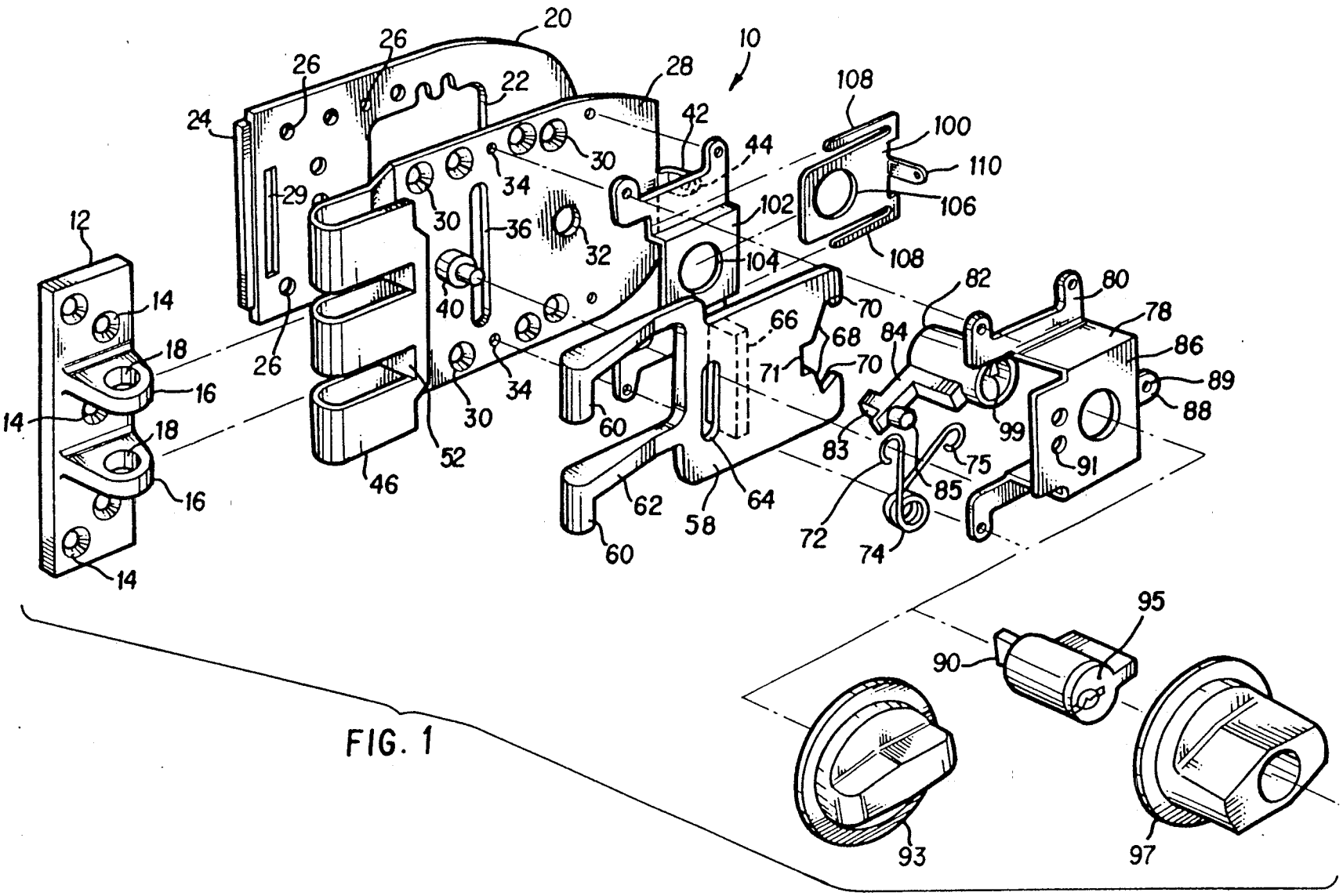
FIG. 1 is an exploded perspective view of the dropbolt lock of this invention with its cover removed.

A dropbolt lock 10 is operable with a stationary strike 12. The strike 12 has suitable mounting holes 14 for rigidly mounting to a door frame or the like by screws. As is common, the strike has bolt holding spaced projections 16 with bolt holes 18 therein.

Figure 3:
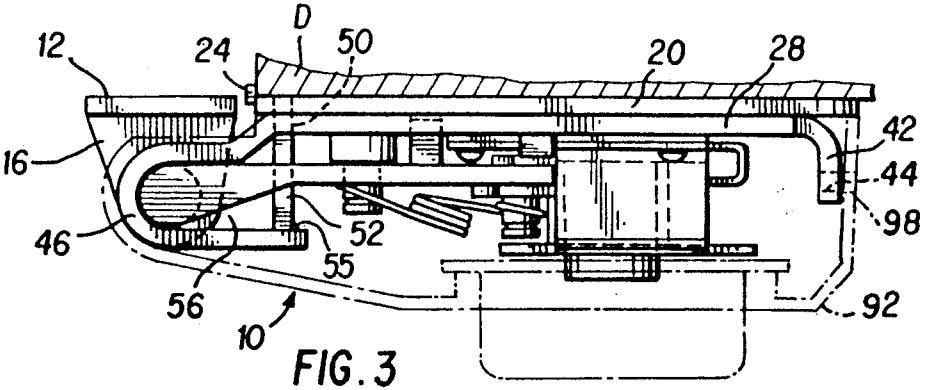
FIG. 3 is a top plan view of the lock as installed with the cover shown in phantom lines.
Figure 2:
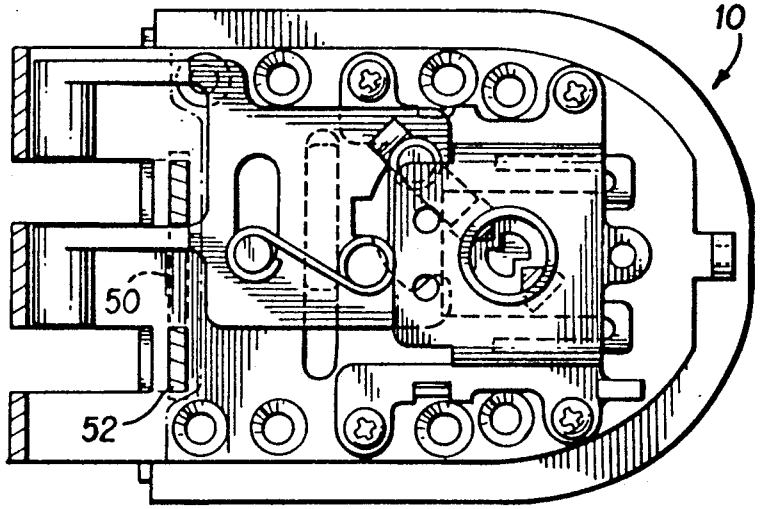
FIG. 2 is a front elevation view with the cover removed.
Figure 4:
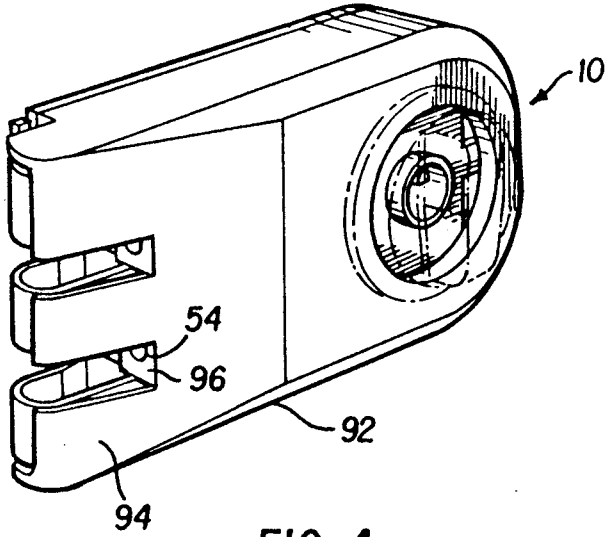
FIG. 4 is a frontal perspective view with a removable thumb turn shown in phantom lines.

The dropbolt lock is assembled on a base plate 20 which is mounted flush with the door D, see FIG. 3. The base plate 20 has an opening 22 for the cylinder lock operating mechanism and has a turned-down lip 24 which fits over the edge of the door and resists prying by preventing the insertion of a sharp instrument underneath the base plate 20. The base plate 20 includes eight screw mounting holes 26 for attachment of the plate flush with the door surface.

An assembly plate 28 on which the lock components are assembled is adapted to be rigidly secured on top of the base plate. The assembly plate 28 also has eight screw assembly mounting holes 30 corresponding with the holes 26 when the base plate and assembly plate are rigidly secured together. The assembly plate also has a lock operator opening 32 and has four cam assembly tapped and threaded screw mounting holes 34. The assembly plate 28 further contains a cam guide slot 36 as well as a spring mounting and cam stop post 40.

At one end of the assembly plate 28 there is an upturned portion 42 having a drilled and tapped cover mounting hole 44. At the other end of the assembly plate 28 there are a plurality of reverse curve knuckle portions 46. The assembly plate is made of stamped and rolled steel which is more uniform and much stronger than conventional brass castings, and also it makes the assembly plate easy to manufacture and assists in ease of assembly of the entire lock.

Figure 6:
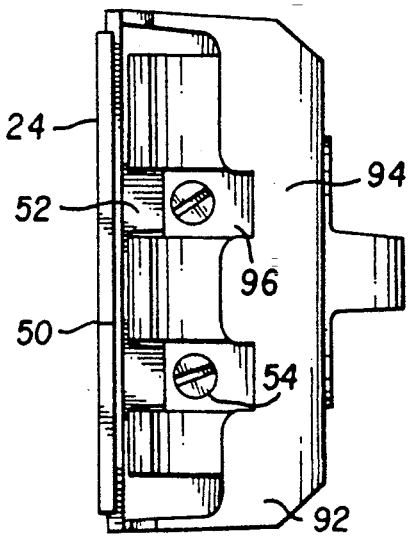
FIG. 6 is an end elevation view from the end of the lock adjacent the strike with the lock in unlocked position.

Also attached to the assembly plate 28 is a cover mounting plate 48 which has a base extension 50 extending through a slot 29 in the base plate 20 and a corresponding slot in assembly plate 28. The cover mounting plate 48 has a pair of spaced arms 52, each of which includes drilled and tapped cover mounting holes to accommodate screws 54 (see FIG. 6) for attachment of the lock's cover as described hereinafter. The tips of arms 52 of cover mounting plate 48 and the reverse curve knuckle portions 46 are welded together at 55 and provide a bolt space 56 for a dropbolt.

A locking bolt member 58 includes a pair of cylindrical bolt portions 60, each of which is mounted on a bolt arm 62. Member 58 also includes a movement limiting slot 64 and a guide boss 66 which boss is slidable in guide slot 36 when the member 58 is moved. The locking bolt member 58 has a pair of cam follower surfaces 68 spaced approximately 90° apart and slightly curved as shown in the drawings. Each of these surfaces are terminated by hook stops 70 at each end and a rectangular recess 71 in the center.

The post 40 holds end 72 of a tension spring 74 and also acts as a stop, cooperating with the ends of slot 64 to limit the extent of movement of locking bolt member 58.

A cam assembly includes a cam support cage 78 having four mounting tabs 80 for mounting to holes 34 in the assembly plate. A cam member 82 has a cam arm 84 with a cam surface for contacting the cam follower surfaces 68. A post 85 is provided for end 75 of spring 74. The ends of spring 74 are held on to the posts by retainers (not shown).

The cam support cage 78 has a thumb turn or cylinder lock support plate 86 which is provided with a mounting tab 88 with a single screw hole 89, and a pair of holes 91 for mounting either a thumb turn 93 or lock cylinder 95 within turn housing 97. A pair of projections (not shown) extend from the underside of thumb turn 93 on housing 97 into holes 91 in plate 86.

A cylinder actuator 90 extends to actuate the cam by contacting lugs 99. A similar cylinder actuator may extend from the lock on the outside of the door as is known in the art.

A cover 92 is provided and has a portion 94 covering the knuckles 46 with depending mounting flanges 96 having mounting holes for screws 54 connecting to holes 54. An end mounting hole 98 cooperates with the top mounting hole 44 in upturned end 42 of the assembly plate 28.

A shutter 100 is slidably mounted on a shutter holder 102 for closing a passage 104 when the dropbolt is open. When the cylinder actuator is removed, the shutter has a metal insert 106 which closes opening 104 to prevent access to the lock. The shutter has mounting arms 108 and an upstanding finger 110 for connection of a biasing spring (not shown). The shutter is biased to close the opening 104 and prevent access to the cam 82 if the cylinder on the outside of the door is removed, thus making the lock more difficult to defeat.

To install, plate 20 is assembled flush with the door as shown in FIG. 3 with lip 24 overhanging the door edge. If the position of the strike is such that additional spacing of the lock from the surface of the door is desired, additional plates 20 may be utilized in the nature of shims.

A guard plate assembly 112 carrying a cylinder lock 114 may be positioned on the outside of the door and attached by parts or bolts 116 to base plate 20, thus further enhancing the total security of the lock. The guard plate assembly may be a Medeco BODYGUARD ® and the cylinder lock 114 may be a Medeco BIAXIAL ®, both known and available from Medeco Security Locks in Salem, Va.

The lock assembly plate 28 carrying all of the components is assembled onto the plate 20 and carries all of the components as described. Then the inside actuator, e.g., thumb turn 97, may be placed on the lock and secured by a single screw extending through a hole 98. Thereafter, the cover is installed with the lock open and secured by screws 54 and a screw through hole 44.

In operation, a cam actuator which can either be an actuator of a cylinder on the outside of the door, the actuator 90 of cylinder 95 on locking thumb turn 97, or simply an actuator (not shown) on the back of thumb turn 93 contacts lugs 99 on the cam member 82 to rotate it. This causes cam surface 83 to ride on surfaces 68 to drive member 58 either upwardly or downwardly. In the uppermost position, the cylinder portions 60 are contained within the knuckles 46 while in the down position, the cylinders 60 are contained within the holes 18 of the strike 12. Slot 64 and post 40 limit the extent of movement of the dropbolt. The cam 83 swings 90° to positions just adjacent the hook portion 70 at the end of the cam follower surfaces 68 and in such positions constitute a true dead lock. The thumb turns 93 and 97 may have indicators thereon to indicate whether the lock is locked or unlocked.

As can be seen, the dropbolt lock may be mounted flush with the door with more than the usual amount of mounting screws directly holding the lock assembly to the door with the lip 24 resisting prying. The bolt portions 60 in locked position cover the space 56 and prevent access to screws 54 so that the cover 92 cannot be removed unless the bolt is in unlocked position. The cam cage 78 is a completely removable assembly with the shutter. This allows an ease of assembly directly onto the base plate 28. Moreover, either the cylinder thumb turn 97 or the plain thumb turn 93 or double acting cylinder can be held in place on top plate 86 by means of a single screw through hole 89 further simplifying the assembly and allowing easy removal of parts. Because of the true deadlocking positions of the cam 83, the spring 74 is utilized for assistance and not necessarily for holding in position, i.e., if the spring happened to come off, the lock would still stay locked.

Figure 7:
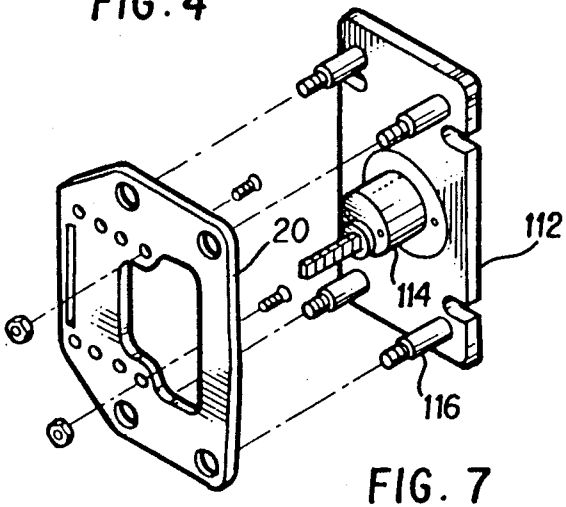
FIG. 7 is an exploded view of a guard plate assembly mounted to the dropbolt lock.
Figure 5:
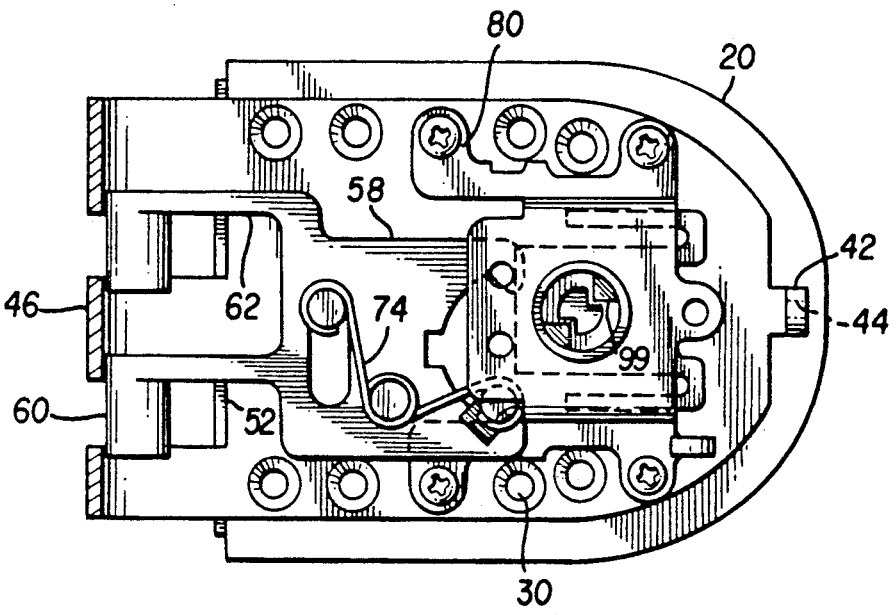
FIG. 5 is a front elevation view with the cover removed and showing the lock in locking position.

The locking bolt is made of copper infused steel, not steel stampings or brass castings and hence, is quite strong and resistant to cutting. The assembly plate 28 is made of stamped and rolled steel, is more uniform and stronger, and easier to make and easier to assemble than the usual brass castings and moreover, brass castings tend to the break in the knuckle area around the bolt. The lock assembly is adapted for use with Medeco's BODYGUARD ® guard plate and Medeco's BIAXIAL ® cylinder locks which can be mounted on the outside of the door as shown in FIG. 7 to provide a very secure assembly. The thumb turns 93 or 97 are easy to grasp for handling and can provide an indicator.

Various modifications are apparent to those skilled in the art from the description of the preferred embodiment and this invention is not to be limited by the description of the preferred embodiment, but only by the scope of the appended claims and their reasonable equivalence.

We claim:

1. A dropbolt lock assembly of the type including: a plurality of spaced apart knuckles, a movable dropbolt slidable within the spaced knuckles, a cam assembly operably connected to the dropbolt to move the dropbolt from a locked position to an unlocked position, the cam assembly being operable by a cylinder lock, a cover for the cam assembly, and means for securing the lock assembly to a door to be locked with improvements comprising: the spaced knuckles being formed integrally with an assembly plate formed of stamped and rolled steel, a mounting base plate flush with the assembly plate means, screw holes in the assembly plate and base plate for attachment of such plates flush with the surface of a door to which the lock is mounted, and screw means for attaching the cover to the lock assembly, the screw means positioned to be accessible between the spaced knuckles only when the dropbolt is in unlocked position.

2. A dropbolt assembly of the type including: a plurality of spaced apart knuckles, a movable dropbolt slidable within the spaced knuckles, a cam assembly operably connected to the dropbolt to move the dropbolt from a locked position to an unlocked position, the cam assembly being operable by a cylinder lock, a cover for the cam assembly, and means for securing the lock assembly to a door to be locked with improvements comprising: the spaced knuckles being formed integrally with an assembly plate formed of stamped and rolled steel, a mounting base plate flush with the assembly plate means, screw holes in the assembly plate and base plate for attachment of such plates flush with the surface of a door to which the lock is mounted, wherein the base plate means includes at least one flat plate with an edge lip for fitting over the edge of a door on mounting.

3. A dropbolt lock assembly as in claim 2 wherein the base plate means includes a plurality of identical flat plates to provide shim action for mounting the lock assembly for correct positioning.

4. A dropbolt assembly as in claim 2 wherein there are more than four screw holes in the assembly plate and base plate means.

5. A drop bolt lock assembly as in claim 2 wherein a cover is secured to the assembly plate means by attachment means which are inaccessible when the dropbolt is in locked position.

6. A dropbolt assembly of the type including: a plurality of spaced apart knuckles, a movable dropbolt slidable within the spaced knuckles, a cam assembly operably connected to the dropbolt to move the dropbolt from a locked position to an unlocked position, the cam assembly being operable by a cylinder lock, a cover for the cam assembly, and means for securing the lock assembly to a door to be locked with improvements comprising: the spaced knuckles being formed integrally with an assembly plate formed of stamped and rolled steel, a mounting base plate flush with the assembly plate means, screw holes in the assembly plate and base plate for attachment of such plates flush with the surface of a door to which the lock is mounted, wherein the cover is secured to the assembly plate means by attachment means which are inaccessible when the dropbolt is in locked position, and wherein the attachment means are screws which are accessible through spaces between the spaced knuckles when the dropbolt is in unlocked position.

7. A dropbolt lock assembly of the type including: a plurality of spaced apart knuckles, a movable dropbolt slidable within the spaced knuckles, a cam assembly operably connected to the dropbolt to move the dropbolt from a locked position to an unlocked position, the cam assembly being operable by a cylinder lock, a cover for the cam assembly, and means for securing the lock assembly to a door to be locked with improvements comprising: the cam assembly being self-contained in a cage, means for mounting the cam assembly cage directly to the assembly plate base.

8. A dropbolt lock assembly as defined in claim 7 further comprising a cylinder lock to operate the cam assembly.

9. A dropbolt lock assembly as in claim 8 wherein the cylinder lock is secured to the cam assembly cage by a single screw means.

10. A dropbolt assembly as defined in claim 7 wherein a thumb turn assembly is attached to the cam cage.

11. A dropbolt assembly as defined in claim 10 wherein the attachment is by means of a single screw.

12. A dropbolt lock assembly of the type including: a plurality of spaced apart knuckles, a movable dropbolt slidable within the spaced knuckles, a cam assembly operably connected to the dropbolt to move the dropbolt from a locked position to an unlocked position, the cam assembly being operable by a cylinder lock, a cover for the cam assembly, and means for securing the lock assembly to a door to be locked with improvements comprising: a dropbolt is formed integral with a cam follower portion to be operated by the cam assembly, the cam follower portion formed of two surfaces extending generally at right angles to each other so that the cam follower surfaces and cam assembly assume a true dead locking position on 90° rotation of the cam.

13. A dropbolt lock assembly as defined in claim 12 wherein the dropbolt is formed of copper and filtrated steel.

14. A dropbolt assembly as defined in claim 12 wherein the dropbolt is slidable in a straight line by virtue of guide means cooperating between a surface of the bolt and the assembly plate means.

15. A dropbolt lock assembly as described in claim 14 further comprising a base plate mounted flush with a door and holding the dropbolt lock, a guard plate and cylinder lock mounted on an opposite side of the door and attached to the base plate by post means.

* * * * *